US010285561B2

(12) United States Patent
O'Brien et al.

(10) Patent No.: US 10,285,561 B2
(45) Date of Patent: May 14, 2019

(54) DISHWASHER BASE STRUCTURE

(71) Applicant: WHIRLPOOL CORPORATION, Benton Harbor, MI (US)

(72) Inventors: Thomas M. O'Brien, Saint Joseph, MI (US); William K. Kangas, Buchanan, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 16/043,915

(22) Filed: Jul. 24, 2018

(65) Prior Publication Data

US 2018/0325351 A1 Nov. 15, 2018

Related U.S. Application Data

(62) Division of application No. 15/400,070, filed on Jan. 6, 2017.

(51) Int. Cl.
*A47L 15/42* (2006.01)

(52) U.S. Cl.
CPC ..... *A47L 15/4272* (2013.01); *A47L 15/4253* (2013.01); *A47L 15/4246* (2013.01)

(58) Field of Classification Search
CPC ..... A47L 15/4246; A47L 15/4272; A47L 15/4251; A47L 15/4253; A47L 5/427; A47L 15/4261; A47L 15/4265; D06F 39/125; D06F 39/12; F25D 2323/0011; A47B 91/005
USPC ..... 312/228, 351.7, 351.5, 351.1, 351.3, 312/351.4, 351.8, 351.12, 351.13, 311, 312/351.6; 248/188.91, 677, 676, 673, 248/672, 188.1, 678, 637; 68/3 R; 134/58 D, 201, 56 D, 57 D
See application file for complete search history.

(56) References Cited

U.S. PATENT DOCUMENTS

| | | | | | |
|---|---|---|---|---|---|
| 4,359,250 | A * | 11/1982 | Jenkins | A47L 15/4246 | 312/228 |
| 4,940,298 | A * | 7/1990 | Jackson | A47L 15/4246 | 312/228 |
| 5,230,553 | A * | 7/1993 | Tuller | A47L 15/4246 | 312/228 |
| 5,613,747 | A * | 3/1997 | Becker | A47L 15/4265 | 312/228 |
| 5,741,054 | A * | 4/1998 | Becker | A47L 15/4253 | 134/201 |
| 5,860,436 | A | 1/1999 | Hobday | | |

(Continued)

FOREIGN PATENT DOCUMENTS

| | | |
|---|---|---|
| EP | 0711527 A1 | 5/1996 |
| EP | 1306046 A1 | 5/2003 |
| EP | 2654542 B1 | 3/2015 |

OTHER PUBLICATIONS

European Search Report for Corresponding EP18150473.9, dated Feb. 18, 2018.

*Primary Examiner* — Hiwot E Tefera
(74) *Attorney, Agent, or Firm* — McGarry Bair PC

(57) ABSTRACT

A dishwasher with a tub defining a treating chamber having an access opening. A closure selectively closes the access opening and a base supports the tub. The base can include a set of spaced panels and a set of spaced beams connecting the set of panels. The base can be formed by inserting the set of spaced beams within the set of spaced panels.

6 Claims, 6 Drawing Sheets

(56) References Cited

U.S. PATENT DOCUMENTS

| | | | | |
|---|---|---|---|---|
| 6,045,205 | A * | 4/2000 | Dingler | A47L 15/4272 134/201 |
| 6,666,531 | B2 * | 12/2003 | Flowers | A47L 15/4272 134/201 |
| 6,764,147 | B2 * | 7/2004 | Flowers | A47L 15/4272 134/201 |
| 7,004,440 | B2 * | 2/2006 | Williams | A47L 15/4272 134/201 |
| 8,136,896 | B2 * | 3/2012 | Woo | D06F 39/125 312/228 |
| 8,341,981 | B2 * | 1/2013 | Kim | D06F 39/125 312/228 |
| 8,757,740 | B2 | 6/2014 | Buhlmeyer et al. | |
| 9,155,443 | B2 | 10/2015 | Bennett et al. | |
| 9,357,899 | B2 | 6/2016 | Bhajak et al. | |
| 2003/0098634 | A1 | 5/2003 | Retsema | |
| 2004/0201334 | A1 * | 10/2004 | Williams | A47L 15/4272 312/228 |
| 2005/0092353 | A1 | 5/2005 | Retsema | |
| 2007/0246084 | A1 * | 10/2007 | Welch | A47L 15/0084 134/56 D |
| 2015/0090859 | A1 | 4/2015 | Deryckere | |
| 2016/0010719 | A1 * | 1/2016 | Kim | F16F 15/08 312/228 |

* cited by examiner

DISHWASHER BASE STRUCTURE

RELATED APPLICATIONS

This application claims the benefit of U.S. patent application Ser. No. 15/400,070, filed on Jan. 6, 2017, and entitled Dishwasher Base Structure, the entirety of which is incorporated herein by reference.

BACKGROUND OF THE INVENTION

Contemporary automatic dishwashers for use in a typical household can include a base structure that provides support for a tub defining a treating chamber for washing dishes. Typically, base structures are metal and require fasteners such as screws and brackets to construct the base. Alternatively, the base structure may be made entirely of plastic. Plastic base structures require complex and expensive tooling, and are not easily modified as is often needed as the dishwasher is updated over the life of the product line.

BRIEF DESCRIPTION OF THE INVENTION

In one aspect, the present disclosure relates to a method for assembling a dishwasher, comprising: forming a base from first and second spaced panels and at least one beam by a first terminal end of the beam into a first socket on the first panel, and inserting a second terminal end of the beam into a second socket on the second panel; mounting to the base a tub defining a treating chamber with an access opening; and movably mounting a closure to at least one of the tub or base.

In another aspect, the present disclosure relates to a method for assembling a dishwasher, comprising: forming a base by inserting spaced terminal ends of each beam of a pair of beams into corresponding sockets on spaced panels to form a bases comprising spaced panels connected by spaced beams; mounting to the base a tub defining a treating chamber with an access opening; and movably mounting a closure to at least one of the tub or base.

DESCRIPTION OF EMBODIMENTS OF THE INVENTION

Figure 1:
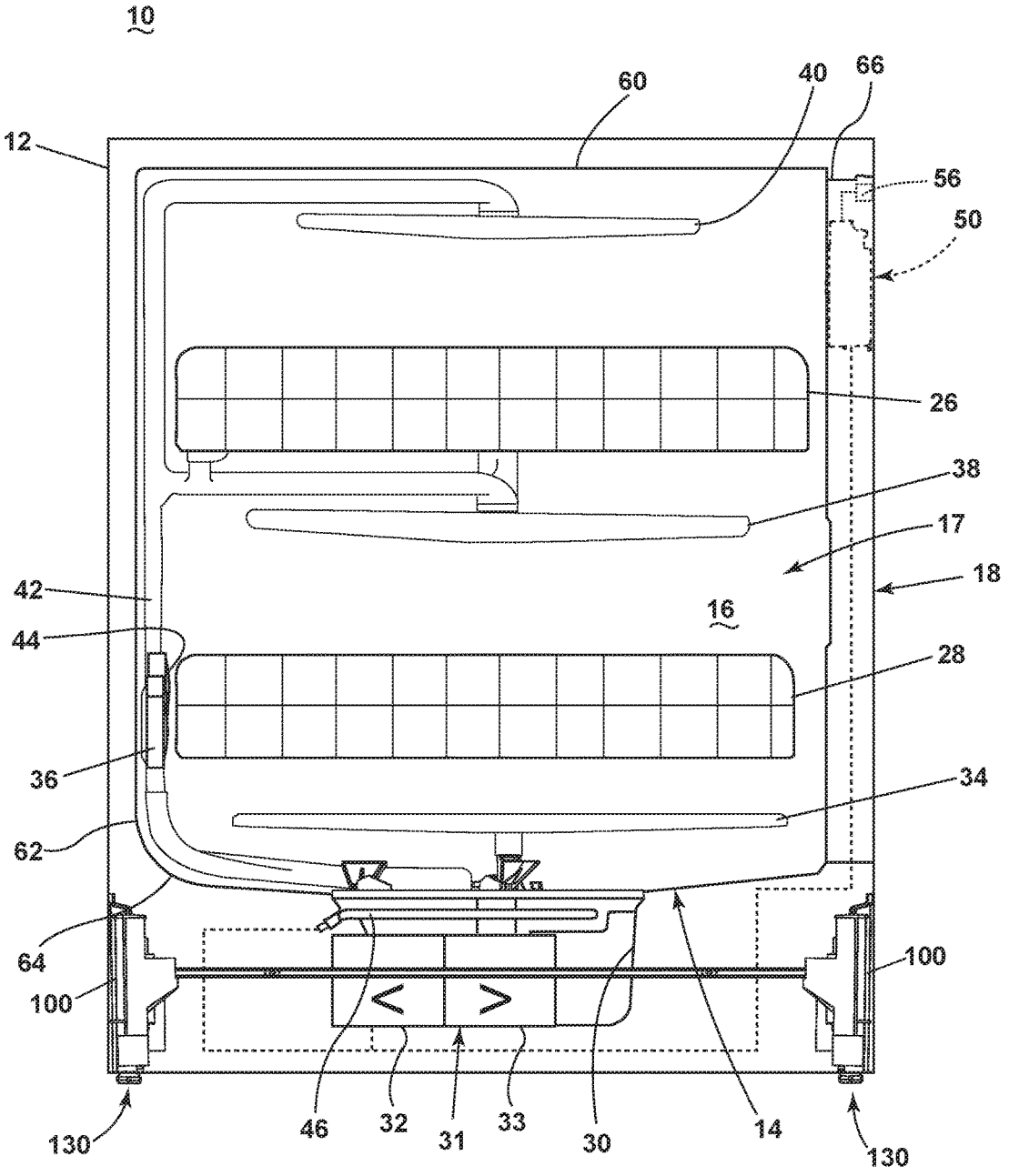
FIG. 1 is a schematic, cross-sectional view of a dishwasher according to an aspect of the present disclosure.

In FIG. 1, an automated dishwasher 10 according to aspects of the present disclosure is illustrated. The dishwasher 10 shares many features of a conventional automated dishwasher, which will not be described in detail herein except as necessary for a complete understanding. A chassis 12 can define an interior of the dishwasher 10 and can include a base 100. By way of non-limiting example, the base 100 can be included in the chassis 12. Further, leveling assemblies 130 can be included in each corner of the base 100 to help level the chassis 12. An open-faced tub 14 can be provided within the base 100, such that the base 100 supports the tub 14. The tub 14 can at least partially define a treating chamber 16, having an open face, for washing dishes. A closure, or door assembly 18 can be movably mounted to the dishwasher 10 for movement between opened and closed positions to selectively open and close the open face of the tub 14. Thus, the door assembly provides accessibility to the treating chamber 16 for the loading and unloading of dishes or other washable items.

It should be appreciated that the door assembly 18 can be secured to the lower front edge of the chassis 12 or to the lower front edge of the tub 14 via a hinge assembly (not shown) configured to pivot the door assembly 18. When the door assembly 18 is closed, an access opening 17 to the treating chamber 16 can be closed, whereas the access opening 17 to the treating chamber 16 can be open when the door assembly 18 is open.

Dish holders, illustrated in the form of upper and lower dish racks 26, 28, are located within the treating chamber 16 and receive dishes for washing. The upper and lower racks 26, 28 are typically mounted for slidable movement in and out of the treating chamber 16 for ease of loading and unloading. Other dish holders can be provided, such as a silverware basket. As used in this description, the term "dish(es)" is intended to be generic to any item, single or plural, that can be treated in the dishwasher 10, including, without limitation, dishes, plates, pots, bowls, pans, glassware, and silverware. While the dishwasher 10 is shown with two dish racks, any number of dish racks can be included.

A spray system is provided for spraying liquid in the treating chamber 16 and is provided in the form of a first lower spray assembly 34, a second lower spray assembly 36, a rotating mid-level spray arm assembly 38, and/or an upper spray arm assembly 40. Upper sprayer 40, mid-level rotatable sprayer 38 and lower rotatable sprayer 34 are located, respectively, above the upper rack 26, beneath the upper rack 26, and beneath the lower rack 28 and are illustrated as rotating spray arms. The second lower spray assembly 36 is illustrated as being located adjacent the lower dish rack 28 toward the rear of the treating chamber 16. The second lower spray assembly 36 is illustrated as including a vertically oriented distribution header or spray manifold 44. Such a spray manifold is set forth in detail in U.S. Pat. No. 7,594,513, issued Sep. 29, 2009, and titled "Multiple Wash Zone Dishwasher," which is incorporated herein by reference in its entirety.

A recirculation system is provided for recirculating liquid from the treating chamber 16 to the spray system. The recirculation system can include a sump 30 and a pump assembly 31. The sump 30 collects the liquid sprayed in the treating chamber 16 and can be formed by a sloped or recess portion of a bottom wall of the tub 14. The pump assembly 31 can include both a drain pump 32 and a recirculation pump 33. The drain pump 32 can draw liquid from the sump 30 and pump the liquid out of the dishwasher 10 to a household drain line (not shown). The recirculation pump 33 can draw liquid from the sump 30 and the liquid can be simultaneously or selectively pumped through a supply tube 42 to each of the assemblies 34, 36, 38, 40 for selective spraying. While not shown, a liquid supply system can include a water supply conduit coupled with a household water supply for supplying water to the treating chamber 16.

A heating system including a heater 46 can be located within the sump 30 for heating the liquid contained in the sump 30.

A controller 50 can also be included in the dishwasher 10, which can be operably coupled with various components of the dishwasher 10 to implement a cycle of operation. The controller 50 can be located within the door 18 as illustrated, or it can alternatively be located somewhere within the chassis 12. The controller 50 can also be operably coupled with a control panel or user interface 56 for receiving user-selected inputs and communicating information to the user. The user interface 56 can include operational controls such as dials, lights, switches, and displays enabling a user to input commands, such as a cycle of operation, to the controller 50 and receive information.

Figure 2:
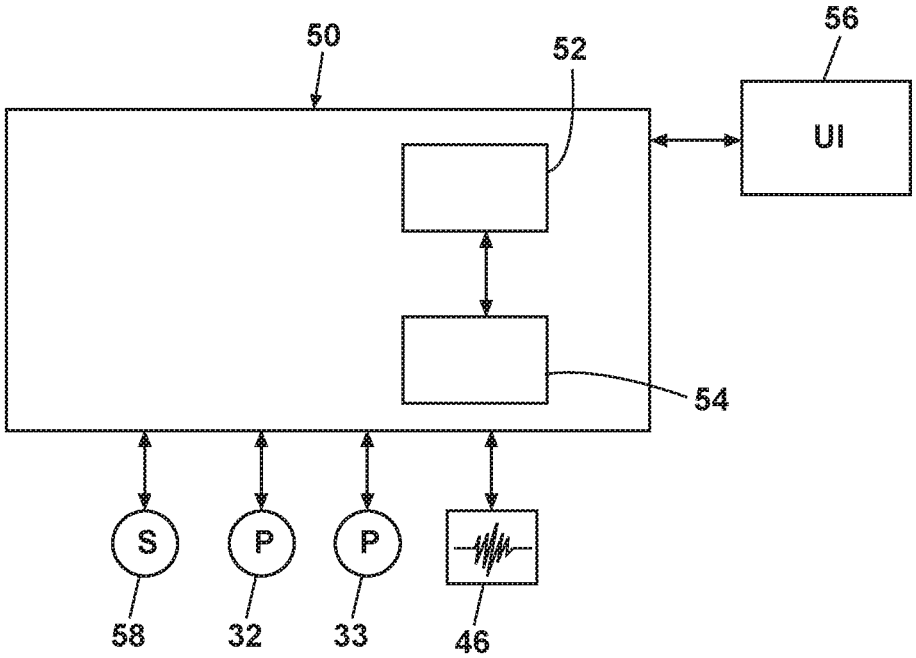
FIG. 2 is a schematic view of a controller of the dishwasher of FIG. 1.

As illustrated schematically in FIG. 2, the controller 50 can be coupled with the heater 46 for heating the wash liquid during a cycle of operation, the drain pump 32 for draining liquid from the treating chamber 16, and the recirculation pump 33 for recirculating the wash liquid during the cycle of operation. The controller 50 can be provided with a memory 52 and a central processing unit (CPU) 54. The memory 52 can be used for storing control software that can be executed by the CPU 54 in completing a cycle of operation using the dishwasher 10 and any additional software. For example, the memory 52 can store one or more pre-programmed cycles of operation that can be selected by a user and completed by the dishwasher 10. The controller 50 can also receive input from one or more sensors 58. Non-limiting examples of sensors that can be communicably coupled with the controller 50 include a temperature sensor and turbidity sensor to determine the soil load associated with a selected grouping of dishes, such as the dishes associated with a particular area of the treating chamber.

Figure 3:
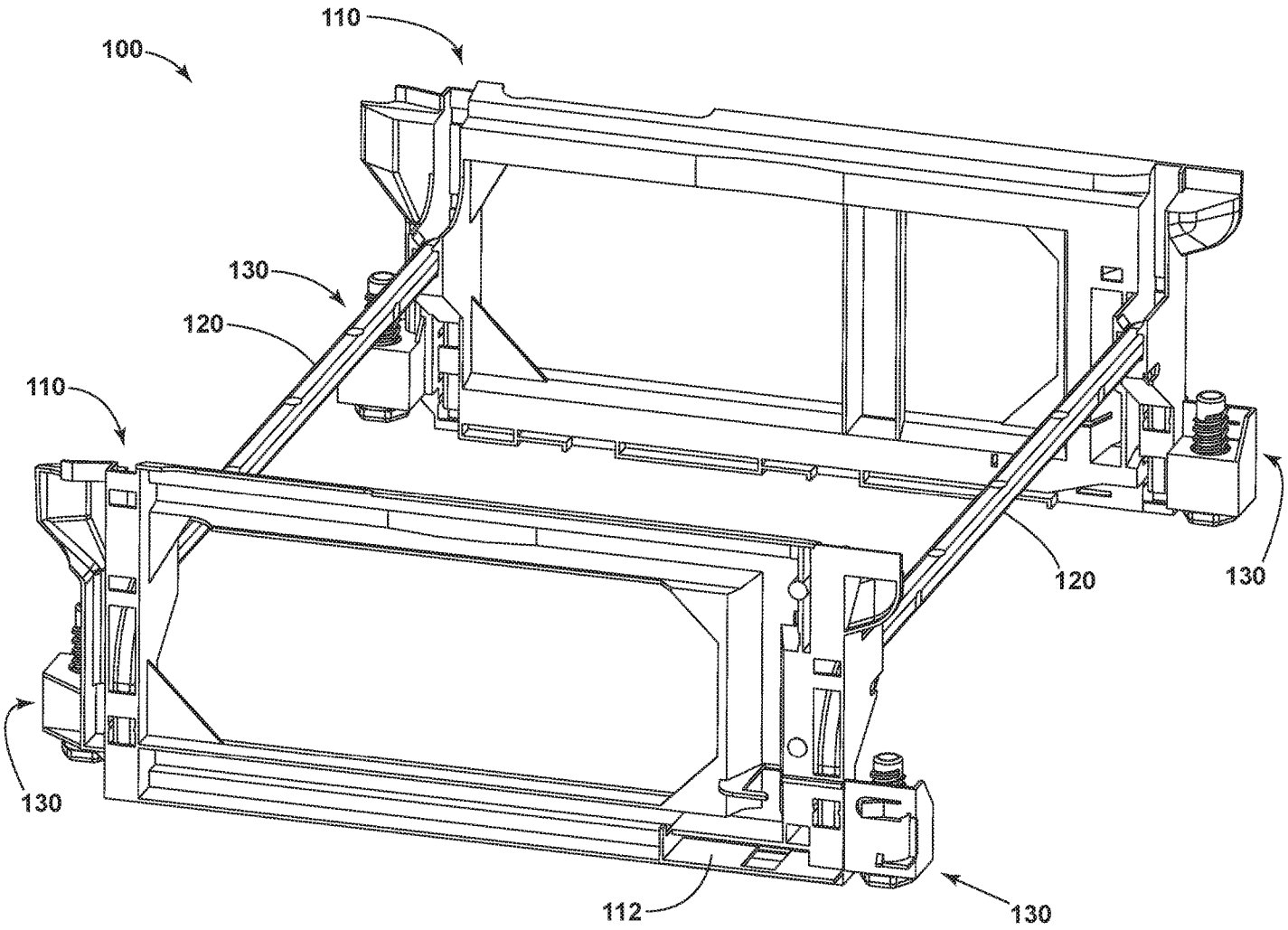
FIG. 3 is a perspective view of an exemplary base according to aspects of the present disclosure.

FIG. 3 illustrates a perspective view of the base 100 according to an exemplary aspect of the disclosure. The base 100 can include a set of spaced panels 110 and a set of spaced beams 120 connecting the set of panels 110. The panels 110 can be made of plastic and can include multiple mounting bosses 112. The mounting bosses 112 can serve to mount other parts of the dishwasher, such as hinges and brackets. It can be seen that the panels 110 can have a generally rectangular profile, or in other words, a rectilinear planform. Though the panels 110 can be made of plastic, the beams 120 can be made of metal. Therefore, the base 100 can be a combination of metal and plastic components. Furthermore, since the panels 110 can be made of injection molded plastic, the panels 110 can allow for greater versatility in the design, especially in terms of complex 3-D shapes, such as the location of mounting bosses 112 for snap-in features, or leveling assemblies 130, as compared to metal stampings.

In the illustrated example, each panel 110 includes leveling assemblies 130, which are mounted in a corner of the panel 110. It is contemplated that the leveling assemblies 130 can be mounted to the panel 110 in alternate locations and are not limited to corners. For example, it is possible for a leveling assembly 130 to be mounted to a middle of the panel 110. It is also possible for the panels 110 to not include leveling assemblies 130.

Figure 4:
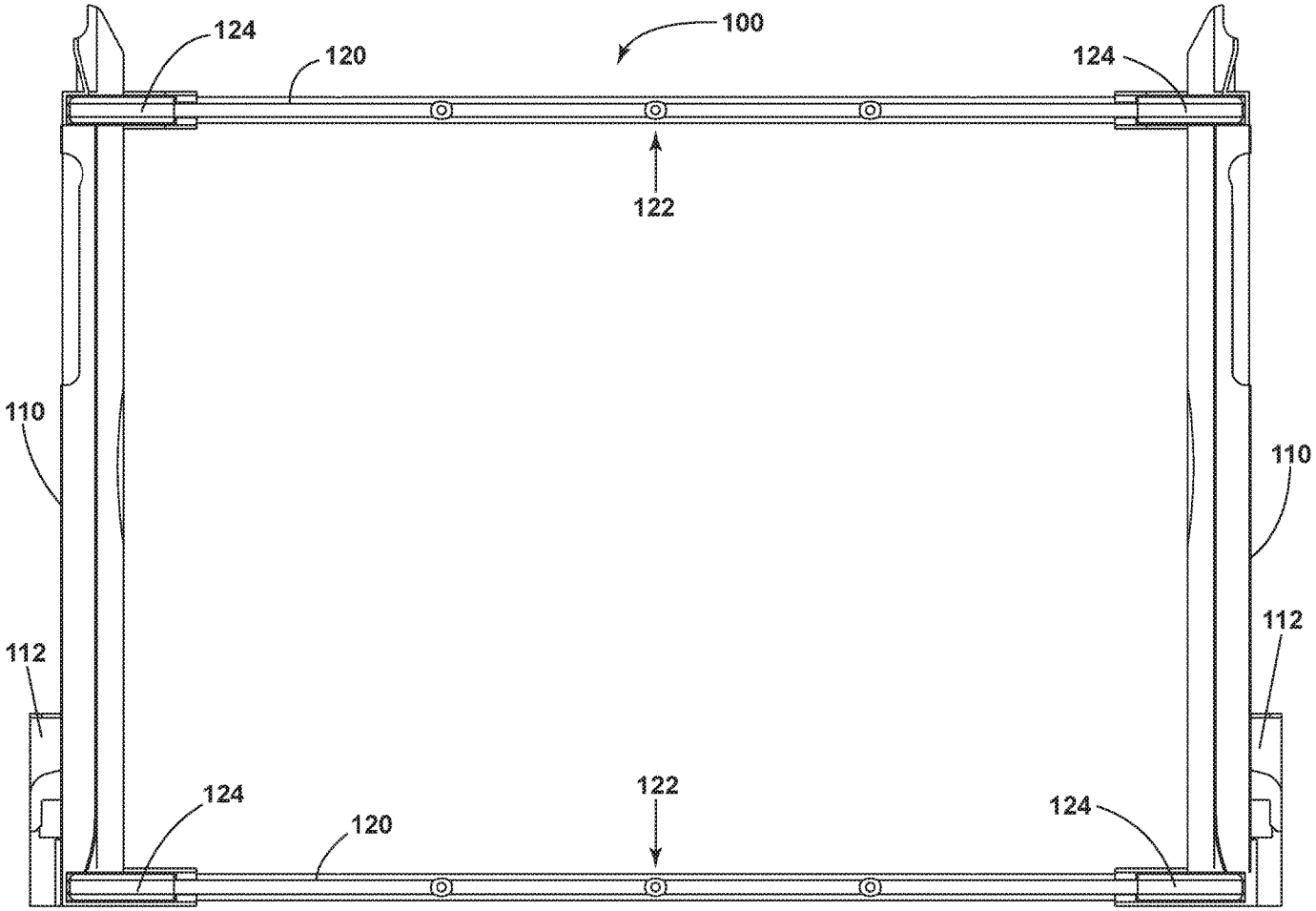
FIG. 4 is a top view of the base of FIG. 3 without leveling assemblies according to aspects of the present disclosure.

FIG. 4 illustrates is a top view of the base of FIG. 3 shown without leveling assemblies 130 according to aspects of the present disclosure. A middle portion 122 of the beams 120 connects terminal ends 124 of the beams 120. The terminal ends 124 connect to the panels 110 such that the beams 120 are generally parallel to each other, the panels 110 are generally parallel to each other, and the beams 120 and the panels 110 are generally perpendicular to each other.

Figure 5:
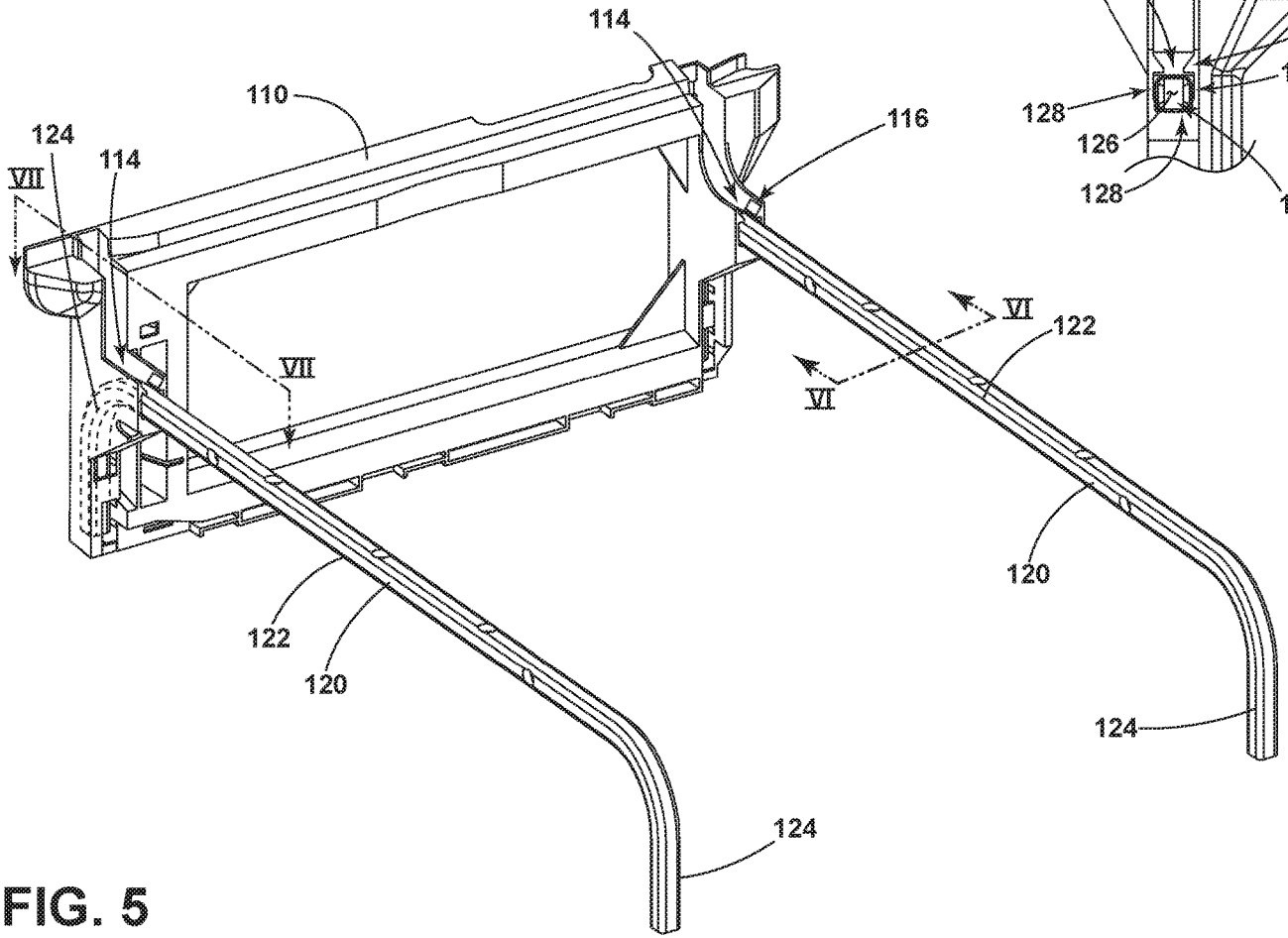
FIG. 5 is perspective view of the base of FIG. 3 without one of the panels.

As best seen in FIG. 5, the terminal ends 124 can be angled or bent relative to the middle portion 122 of the beams 120. Sockets 114 can be provided on the panels 110 that receive the terminal ends 124. The terminal ends 124 can be retained within the sockets 114 by being press-fit into the sockets 114. Alternatively, the terminal ends 124 can be fastened to the sockets 114 by way of a fastener. The fastener can include a resilient finger 116, which can be provided on either one of the beam 120 or the panel 110.

Figure 6:
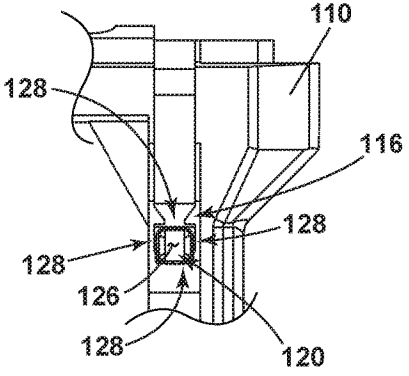
FIG. 6 is a cross-section of line VI-VI in FIG. 5.

FIG. 6 illustrates a cross-section of line VI-VI in FIG. 5, which shows more clearly the cross-section of the beams 120. The beams 120 can be tubular. In the case that the beams 120 are tubular, a hollow interior 126 is located within the beams 120. It can also be seen that the beams 120 can have a generally rectilinear cross-section, such that side-walls 128 of the beams 120 intersect and form generally right angles. Alternatively, the cross-section of the beams 120 can have a different geometry, such as a circular or triangular cross-section.

Figure 7:
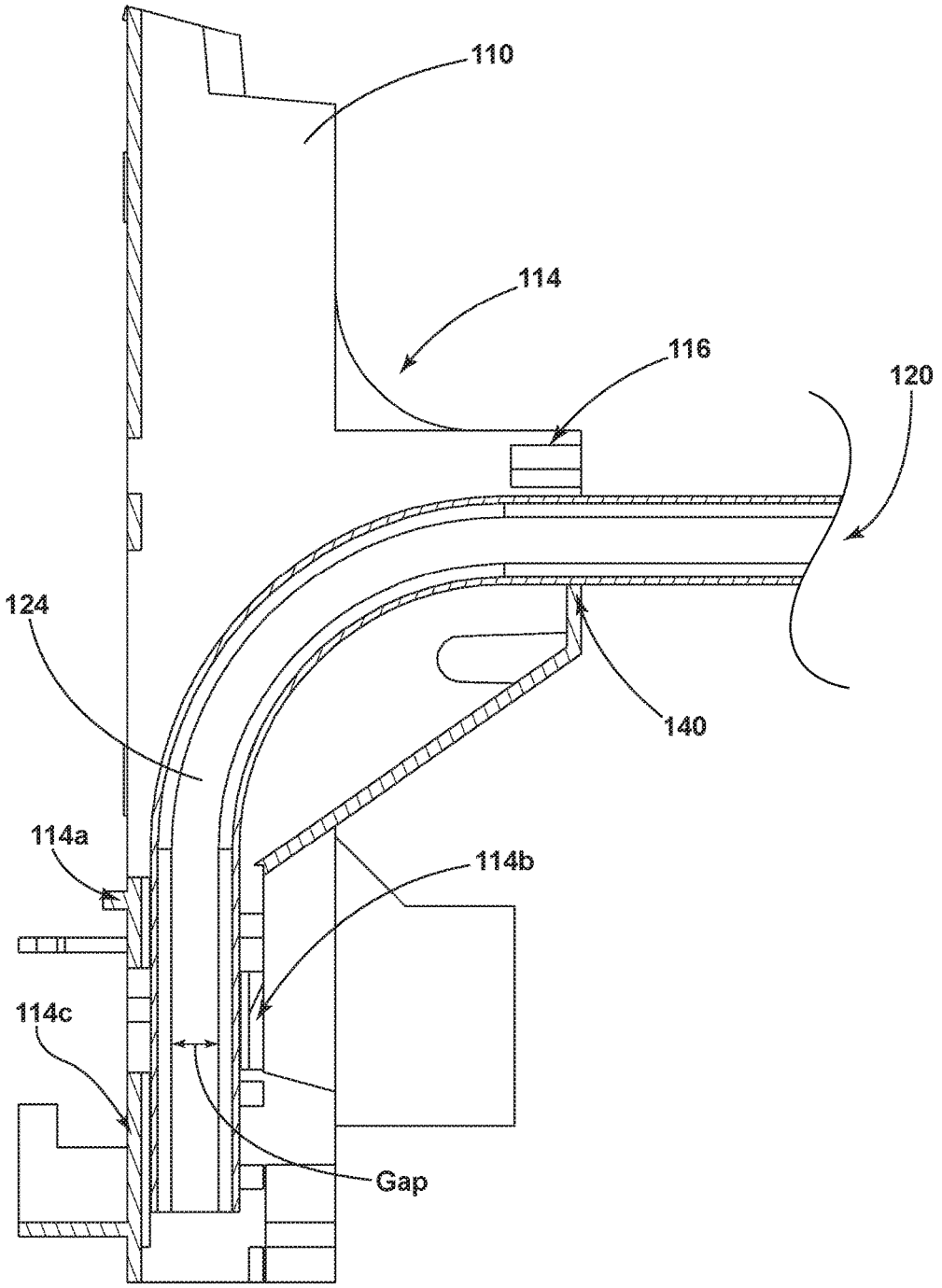
FIG. 7 is a cross-section of line VII-VII in FIG. 5.

Turning to FIG. 7, a cross-section of line VII-VII, it can be seen that the terminal end 124 of the beam 120 fits within the socket 114 of the panel 110. While the terminal end 124 is insert within the socket 114, the beam 120 can abut a stopping point 140 on the panel 110. The middle portion 122 can abut the stopping point 140 such that the beam 120 is positioned and balanced within the panel 110 in order to facilitate adequate support for the tub 14.

The socket 114 can have wall portions 114 *a-c*, which define a gap G that is slightly smaller than the corresponding dimension of the terminal end 124, which provides for a press-fit of the terminal end 124 within the socket 114. One of the wall portions 114 *a-c*, as well as any other portion of the terminal end 124 can have a resilient finger, which can be received within an opening in the terminal end 124 to "lock" the terminal end 124 within the socket 114 in addition to or in lieu of the press-fit connection.

A method for assembling a dishwasher 10 includes forming a base 100 by inserting terminal ends 124 of at least two spaced beams 120 within sockets 114 of at least two spaced panels 110. Next, the method includes mounting to the base 100 a tub 14 defining a treating chamber 16 with an access opening 17 and movably mounting a closure, such as a door assembly 18, to at least one of the tub 14 or base 100. Mounting the tub 14 to the base 100 can include mechanically fastening the tub to the base 100. Furthermore, movably mounting the closure can include hingedly mounting the closure to the base 100.

The method can optionally include press-fitting the terminal ends 124 within the sockets 114 or mechanically coupling the terminal ends 124 to the panels 110.

The method can also optionally include elastically deforming the terminal 124 ends prior or during the inserting. When the terminal ends 124 are inserted within the sockets 114 a positive stop can be provided to limit insertion of the terminal end 124.

The aspects of the disclosure described herein can be used to provide support for a tub for a dishwasher. Aspects of the disclosure can be used to easily assemble a dishwasher base by limiting the number of mechanical fasteners, which decreases assembly cost. Since assembly of the base can be done easily and without the use of mechanical fasteners, the base can be broken down and shipped flat. Additionally, the plastic components of the base help absorb impact during shipping. The use of plastic in the base also provides for a low material cost. It will be understood that while the aspects of the disclosure described herein are shown in the context of a dishwasher, the aspects of the disclosure can be utilized to support any household treating appliance.

To the extent not already described, the different features and structures of the various embodiments can be used in combination with each other as desired. That one feature cannot be illustrated in all of the embodiments is not meant to be construed that it cannot be, but is done for brevity of description. Thus, the various features of the different embodiments can be mixed and matched as desired to form new embodiments, whether or not the new embodiments are expressly described. For example, while the panels 110 can be made of plastic and the beams 120 can be made of metal, it is within the scope of the invention for the panels 110 to be made of metal, or alternatively, the beams 120 to be made of plastic. Moreover, any of the components of the base 100 can be made of any suitable material.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

The invention claimed is:

1. A method for assembling a dishwasher, comprising:

forming a chassis defining an interior;

locating within the interior a tub defining a treating chamber having an access opening;

forming a base, located within the interior and supporting the tub, from first and second spaced panels, the first panel having a pair of first spaced sockets, the second panel having a pair of second spaced sockets, and a set of spaced beams, each beam having opposing first and second terminal ends, by receiving the first terminal end of each beam within a corresponding first socket of the first panel and receiving the second terminal end of each beam into a corresponding second socket of the second panel to form a rectilinear planform; and movably mounting a closure to at least one of the tub or base.

2. The method of claim 1 further comprising press-fitting the first and second terminal ends within the corresponding first and second sockets.

3. The method of claim 1 further comprising mechanically coupling the first and second terminal ends to the panels.

4. The method of claim 1 further comprising elastically deforming the first and second terminal ends prior or during the receiving.

5. The method of claim 1 wherein mounting the tub to the base comprises mechanically fastening the tub to the base.

6. The method of claim 1 wherein movably mounting the closure comprises hingedly mounting the closure to the base.

* * * * *